United States Patent [19]

Yates, Jr.

[11] 3,955,335

[45] May 11, 1976

[54] TETRAHEDRON FORMING MACHINE

[75] Inventor: Robert V. Yates, Jr., Spartanburg, S.C.

[73] Assignee: Deering Milliken Research Corporation, Spartanburg, S.C.

[22] Filed: Mar. 7, 1975

[21] Appl. No.: 556,382

[52] U.S. Cl. ..... 53/55; 53/59 R; 53/64; 53/74

[51] Int. Cl.[2] ..... B65B 57/06; B65B 57/14

[58] Field of Search ..... 53/55, 59 R, 64, 74, 53/142; 193/32, 14, 3

[56] References Cited

UNITED STATES PATENTS

| | | | |
|---|---|---|---|
| 651,433 | 6/1900 | Campbell | 193/3 X |
| 2,782,577 | 2/1957 | Beall | 53/59 R |
| 2,889,676 | 6/1959 | Griffith | 53/59 R |
| 2,925,162 | 2/1960 | De Tuncq | 193/32 X |

*Primary Examiner*—Travis S. McGehee
*Attorney, Agent, or Firm*—H. William Petry; Earle R. Marden

[57] ABSTRACT

Apparatus and method to tumble pack a pre-selected number of tetrahedron containers into a transport container without breaking the seals of any of the tetrahedron containers. A sliding discharge chute is employed which slides into the transport container adjacent the bottom thereof to allow the first few containers to be placed therein without dropping a long distance. Then the chute is slid upward as the rest of the containers are dropped into the transport container.

3 Claims, 14 Drawing Figures

TETRAHEDRON FORMING MACHINE

Prior to this invention tetrahedron and similar containers have been dropped downwardly from a considerable height into a transport container for conveyance to the point of use of purchase. This resulted in a number of containers having the seals broken or leaking due to the impact of the container onto the bottom of the transport container. This occurred primarily to the layer of containers that contact the container first and was caused by the impact on the end or horizontal seal which has not completely cooled after formation by the heat sealing jaws of the packaging machine.

Therefore, it is an object of the invention to provide a method and machine to tumble package a plurality of sealed containers of goods into a transport container for shipment.

Other objects and advantages of the invention will become clearly apparent as the specification proceeds to describe the invention with reference to the accompanying drawings, in which.

Figure 1:
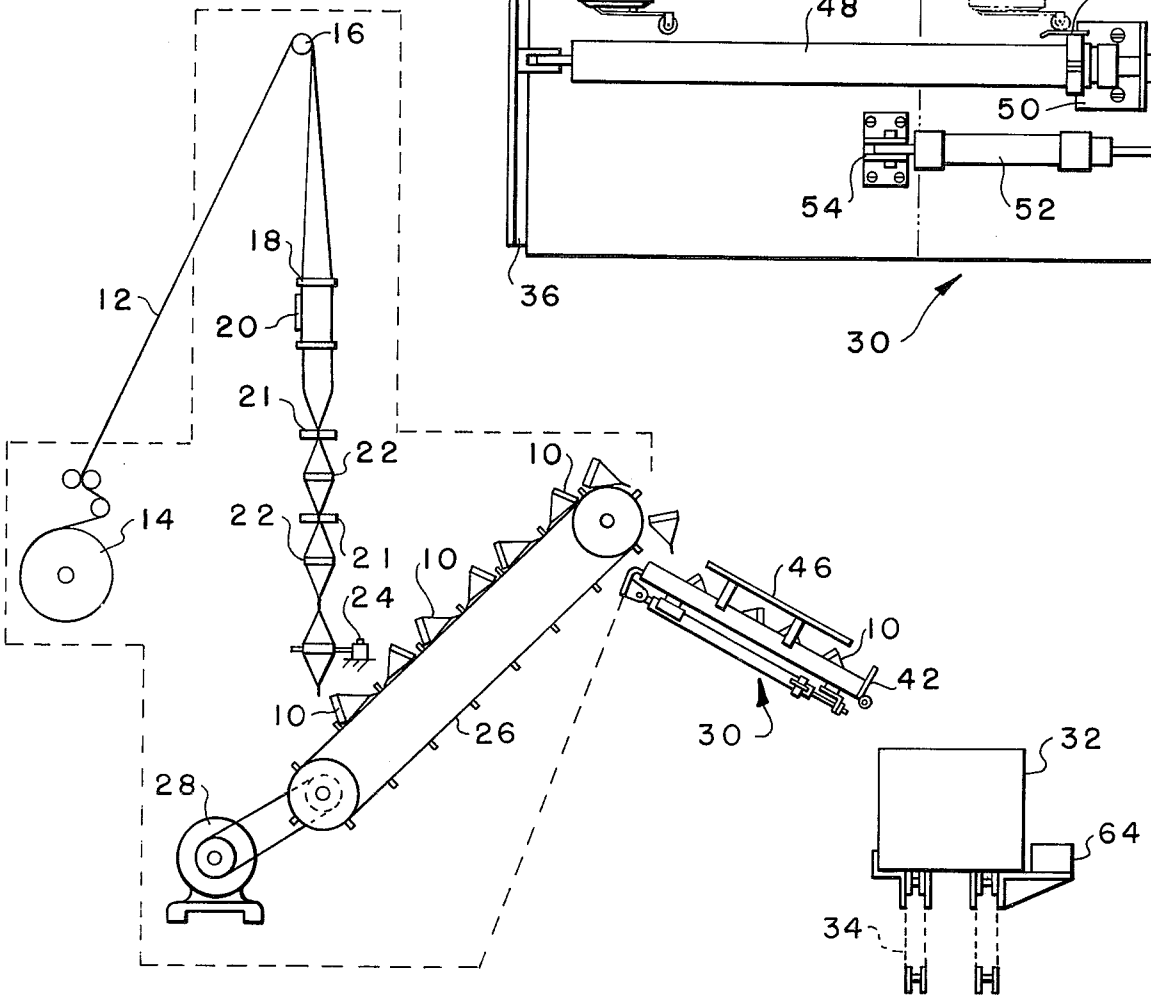
FIG. 1 is a schematic view of a tetrahedron packaging machine and associated tumble pack apparatus.

Looking now to the drawings and particularly to FIG. 1, the invention will be explained. In the preferred embodiment, the invention is directed to the loading of a pre-determined number of tetrahedron shaped packages into a transport container but the invention is not restricted to such shaped packages and is applicable to the loading of any shaped container which has a tendency to break or leak upon impact when dropped into a transport container. In FIG. 1 the tetrahedron shaped packages 10 are formed from a polyethylene coated paper 12 supplied from a roll 14 mounted on the packaging machine. The paper 12 is supplied up and over the breaker roller 16 to the forming ring 18 where it is formed into a tube and the longitudinal edges are heat sealed together by the heater 20. The transverse sealing jaws 21 then clamp the tube and seal the tube and move it downwardly as liquid or granular filling material is being supplied above the seal. Then another set of sealing jaws (not shown) clamp the tube in a position perpendicular to the jaws 21 to form the seals 22 which are perpendicular to the seals made by the jaws 21 to form a filled tetrahedron. This sealing, filling and sealing operation continuously repeats itself and a string of containers are moved downwardly until they are separated into individual containers by the severing device 24 which cuts each seal in the middle thereof. The newly formed tetrahedrons 10 drop onto an endless conveyor 26, driven by a suitable means such as motor 28, and are delivered to the chute 30. From the chute 30 a pre-determined number of tetrahedrons are delivered into the transport container 32 on the conveyor 34. When the transport container 32 is filled with the proper amount of tetrahedron packages, it is allowed to ride down the conveyor 34 to a point of handling.

The tetrahedron forming and packaging machine portion of the invention, indicated by dotted lines in FIG. 1, is a standard commercial machine. This includes the apparatus from the roll 14 through the conveyor 26 which deposits tetrahedron packages 10 into the chute 30. The basic machine also includes a package counter for reasons hereinafter explained.

Figure 4:
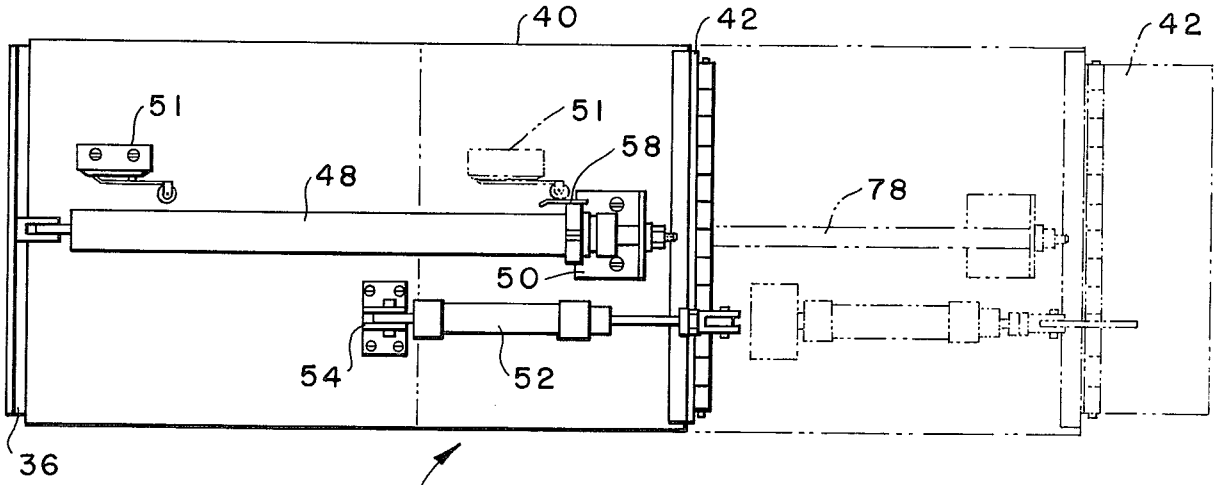
FIG. 4 is a bottom view of the tetrahedron conveying chute taken on line 4—4 of FIG. 2.
Figure 2:
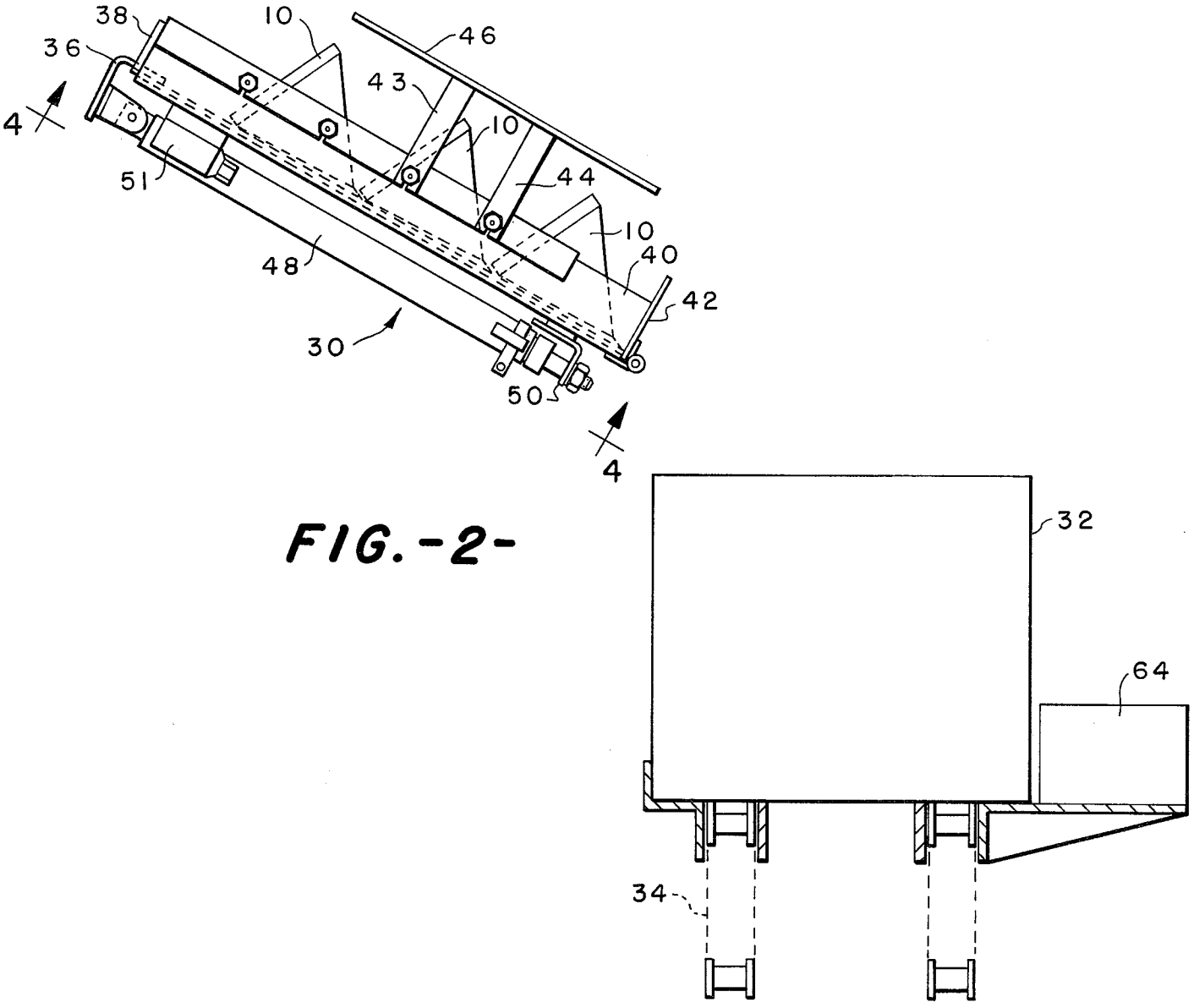
FIG. 2 is a blown-up end view of the transport container and the tetrahedron conveying chute therefor.
Figure 3:
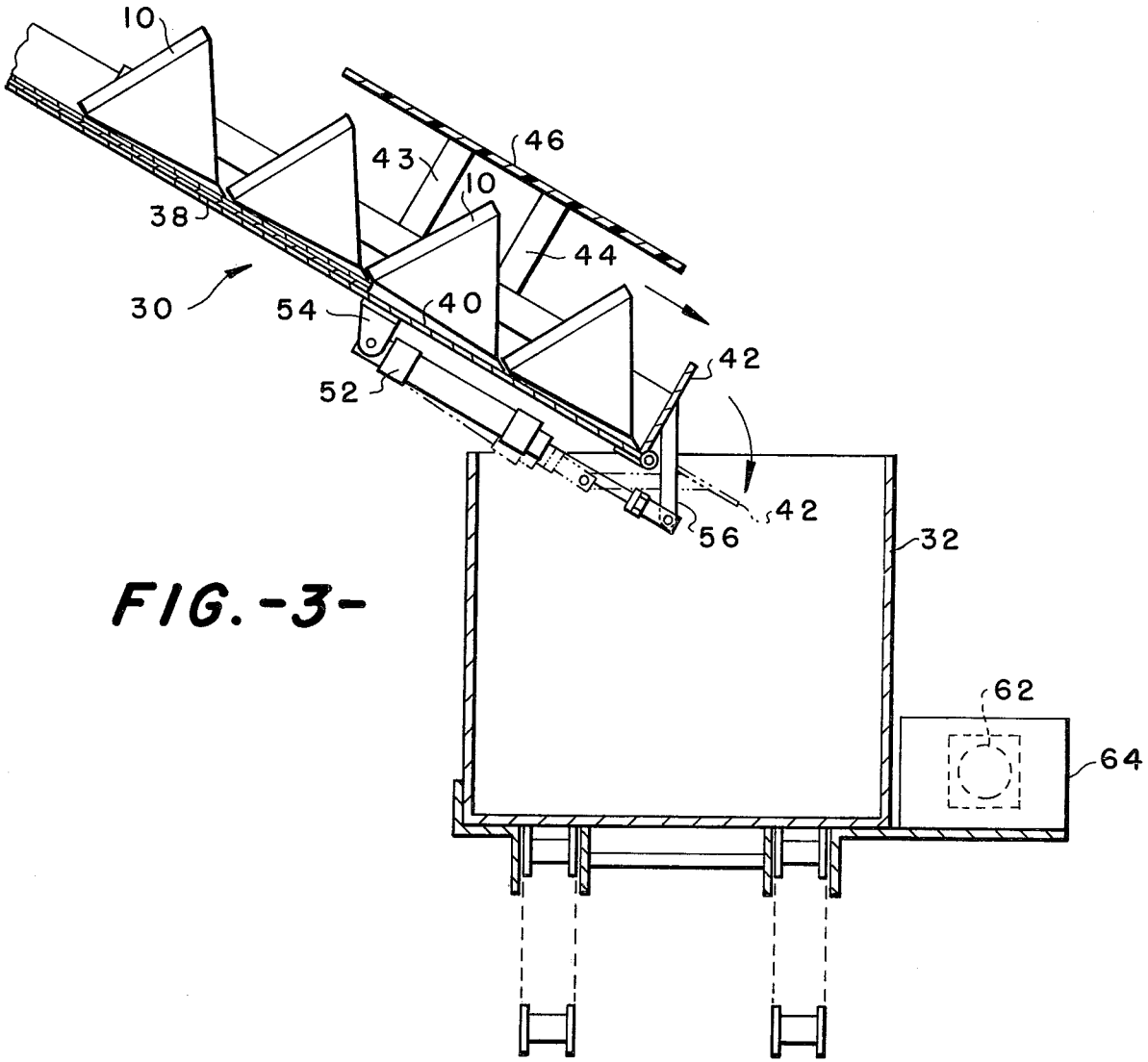
FIG. 3 is a view similar to FIG. 2 taken on line 3—3 of FIG. 5 showing the tetrahedron conveying chute in its expanded position.

Looking now to the chute 30, shown in detail in FIGS. 2–4, it is located at a downward angle from the conveyor 26 to convey tetrahedron packages 10 to the transport container. The chute 30 is mounted to the package forming machine by attachment of the angle iron bracket 36 to the machine by any suitable means, such as bolts or spot welding. The bracket 36 can be integral with or separate from but attached to the U-shaped fixed inner chute portion 38 of the chute 30. Slidably mounted on the outside of the chute portion 38 is the chute portion 40 to which the gate 42 is hinged to at the exit end thereof. Mounted over the top of the chute portion 40 by suitable support arms 43 and 44 is a package deflector 46 to prevent packages 10 from jumping or being displaced upwardly and outwardly from the chute 30. The deflector 46, since it is attached to the slidably mounted chute portion 40, moves with the chute portion 40.

To slide the chute portion 40 in and out a double acting pneumatically operated piston 48 is pivotally mounted at one end to the bracket 36 and fixed at the other end to the bottom of the chute portion 40 by means of a fixed bracket 50. Also mounted on the bottom of the chute portion 40 is another double acting pneumatically operated piston 52 which is pivotally mounted to bracket 54 at one end and connected to linkage 56 at the other end to open and close the chute gate 42. Also mounted on the bottom of the chute portion 40 is a microswitch 51 which is engaged by the actuator 58 when the chute portion 40 is slid outwardly to the dotted line position (FIG. 4).

Figure 5:
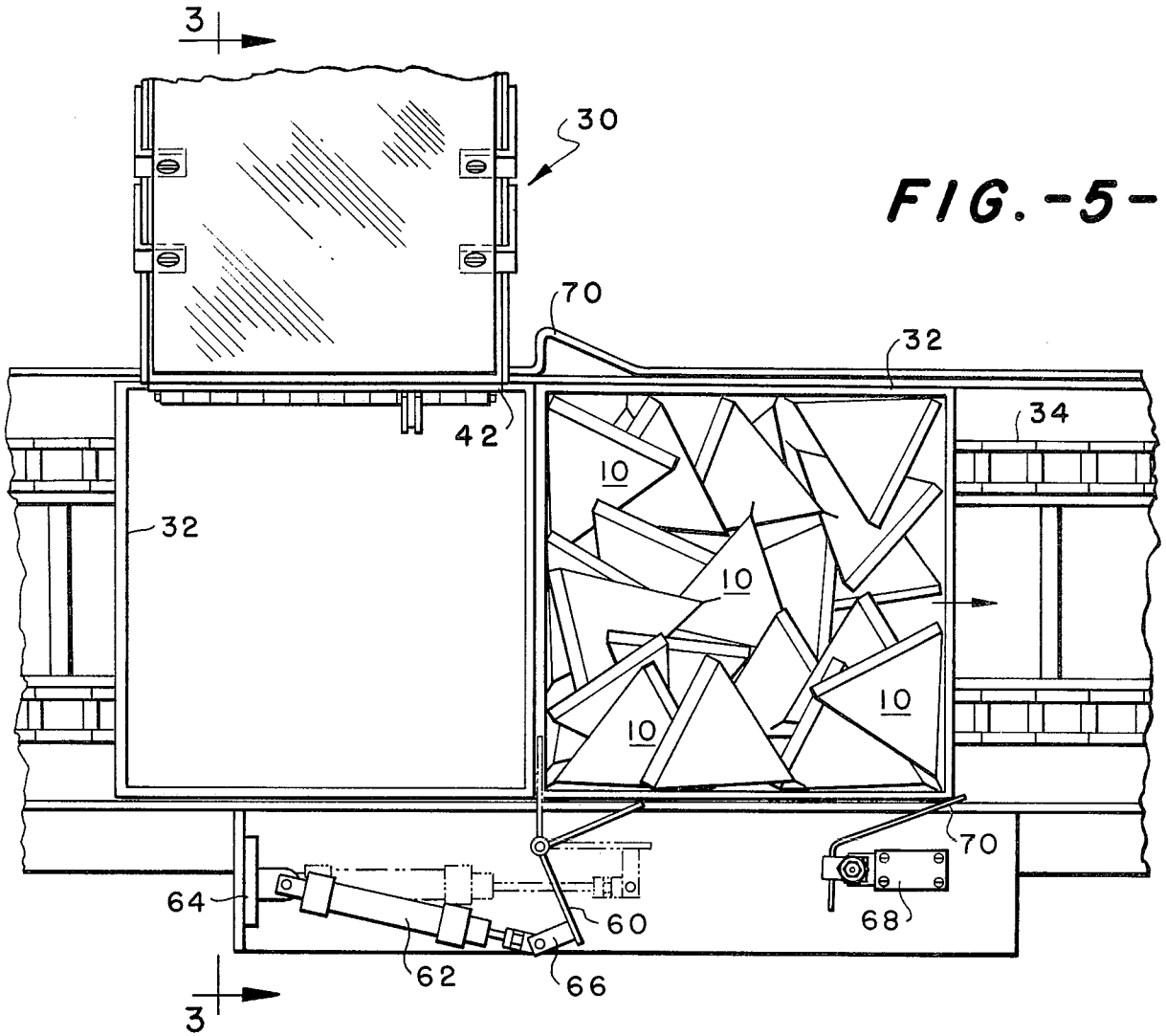
FIG. 5 is a top view of a portion of the tetrahedron conveying chute and transport container.

As discussed briefly before conveyor 34 conveys the empty and full transport containers into the position of disposition, the empty transport containers are loaded on one end of the continuously moving conveyor 34 while the filled containers 32 are taken off at the other end. Located just downstream of the transport container 34 to be filled is a pivotally mounted stop plate 60 (FIG. 5) which in its dotted line position holds an empty transport container in position to be loaded and in its solid line position allows the containers 34 to be transported down the conveyor. The position of the stop plate 60 is controlled by the double acting pneumatically operated piston 62 pivotally connected at one end to the support plate 64 connected to the side of the conveyor 34 and pivotally connected at the other end to the flange 66 connected to the stop plate 60. For reasons explained hereinafter a microswitch 68 is located downstream of the stop plate 60 and is closed by the passage of a transport container against the switch lever 70. It should be noted that the side of the conveyor closest to the chute 30 has a bulged out portion 70 therein to accommodate the corner of a container 32 when the stop plate is being rotated to the dotted line position in FIG. 5.

OPERATION

Figure 6:
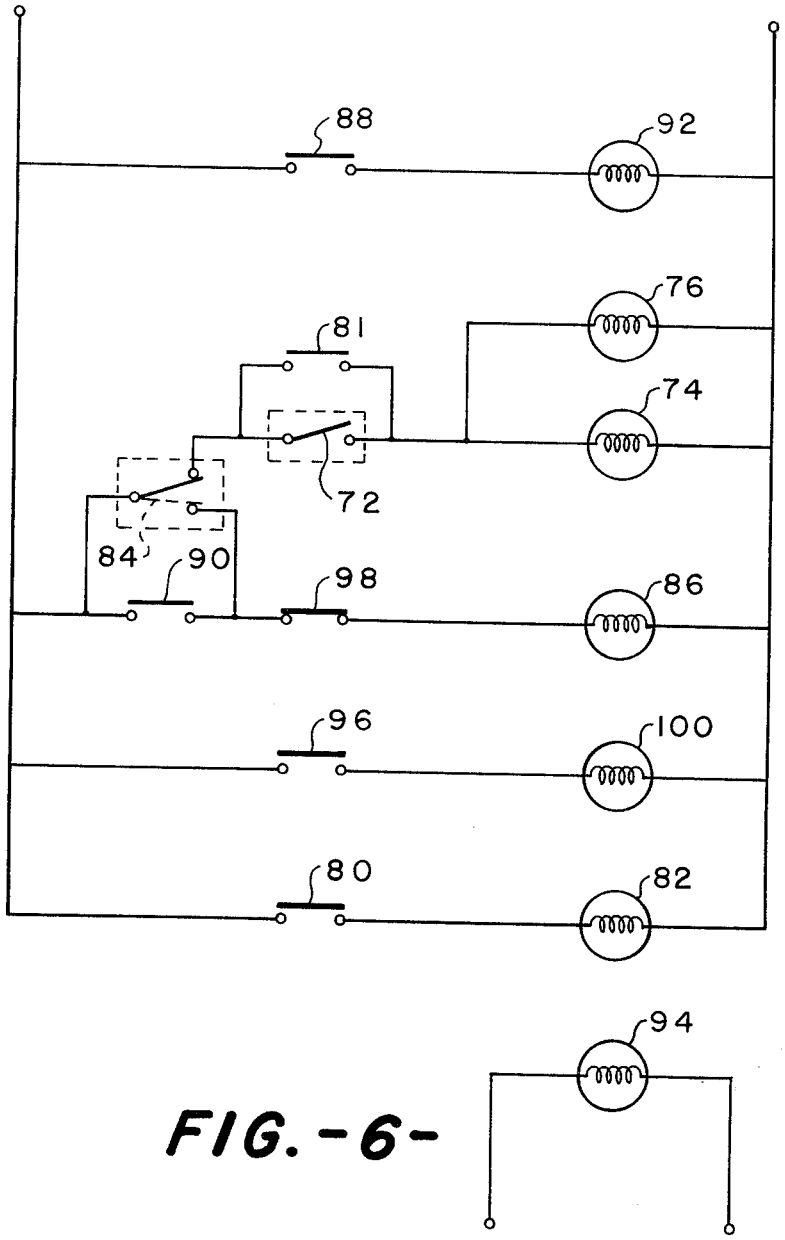
FIG. 6 is a schematic control diagram for the conveying chute and transport container arrangement, and FIGS. 7–14 schematically represents the sequential steps of loading the transport container with tetrahedron containers.
Figure 7:
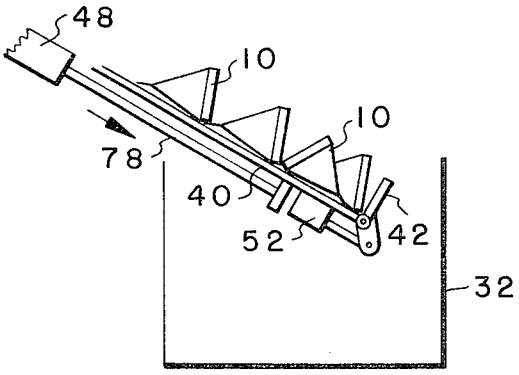
Figure 8:
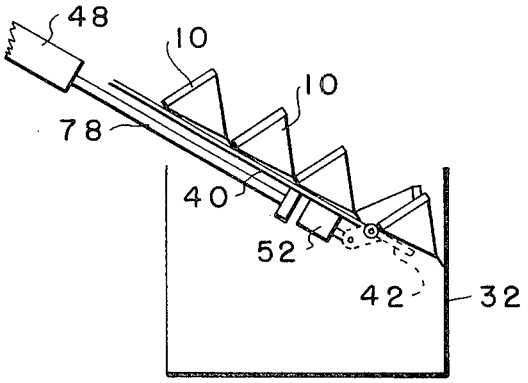
Figure 9:
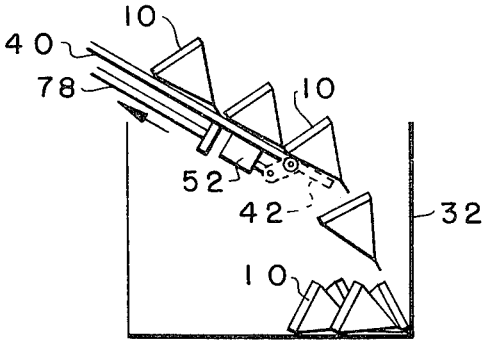
Figure 10:
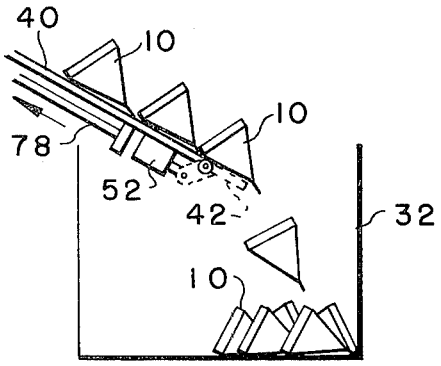
Figure 11:
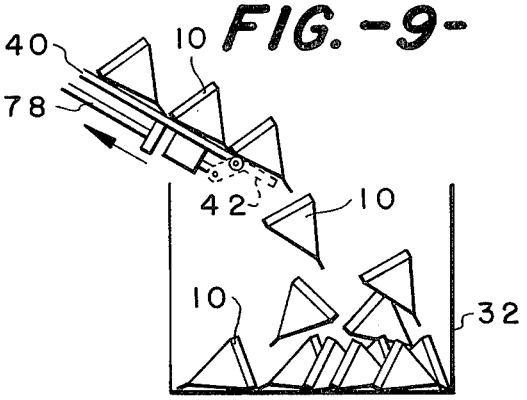
Figure 12:
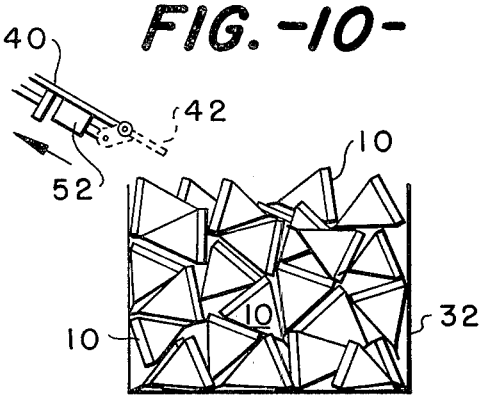
Figure 13:
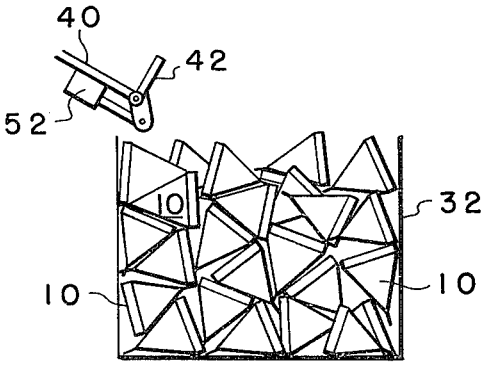
Figure 14:
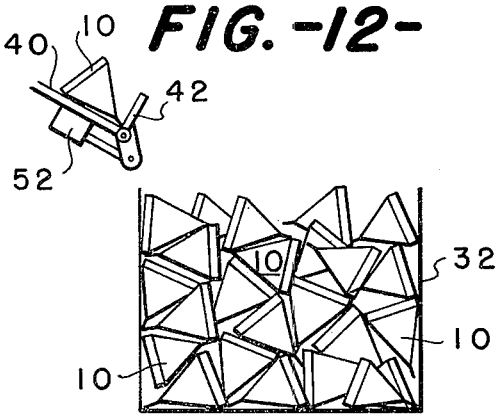

Assume for the sake of discussion that a transport container has just been loaded, stop member 60 is in the solid line position and the filled container is moving out of loading position down the conveyor 34. Looking now at the drawings and in particular to the circuit diagram of FIG. 6 and the sequential drawings of FIGS. 7–14 the operation of the machine will be explained. As the transport container 34 moves down the conveyor it contacts the microswitch 68 to close switch 72 to energize solenoid coils 74 and 76. Energization of coil 76 reverses the flow of air to cylinder 48 causing the piston rod 78 to move outward to move the chute portion 40 downward towards the empty transport container 32. At the same time energization of coil 74 closes switches 80 and 81 to energize coil 82 to reverse the flow of air to piston 62 to move stop member 60 to the dotted line position shown in FIG. 5 to hold the empty container 32 under the chute 30 and to lock in the coil 74, respectively. It should be noted that the stop member 60, in order to assume this position, pushes the corner of the previously filled transport container adjacent the chute into the bulge portion 70 in order to allow the stop member to move into the dotted line position. As the chute portion 40 moves from the position shown in FIG. 7 to the position shown in FIG. 8, the microswitch 51 is contacted by the activator 58 on the piston 48 to move the switch 84 from the solid line position to the dotted line position to energize the coil 86 and break the circuit to coil 74 when the coil 86 is energized it pulls in switches 88 and 90 to energize the coil 92 and to maintain the coil energized 86 to keep the switch 90 closed, respectively. When the switch 88 is closed the solenoid coil 92 is energized to reverse the flow of air to the piston 52 to open the gate 42 to allow tetrahedrons to fall from the chute 30 into the transport container. At the same time, de-energization of coil 76 again reverses the flow of air to the piston 48 to start the retraction of the piston rod 78 as shown in FIGS. 9–12. When the gate 42 first opens a small number of tetrahedrons fall from the chute a short distance into the transport container 32 to form a cushion for the subsequent tetrahedrons which follow as the chute portion 40 retracts thereby increasing the fall distance between the gate 42 and the upper level of packages 10 in the container 32 to allow the desired number of packages to be deposited in the transport container.

When the correct pre-selected number of tetrahedron packages has been counted by the machine counter (not shown) coil 94 is energized to close the switch 96 and open the switch 98. When switch 98 is opened, coil 86 will be de-energized and switch 88 will be opened to de-energize the solenoid coil which reverses the air to the piston 52 to close the gate 42. At the same time, closing of switch 96 will energize the solenoid coil 100 to reverse the operation of piston 62 to open the stop member 60 and allow the filled transport container 32 to pass down the conveyor 34 until it strikes the actuator 70 to repeat the above cycle to fill another transport container with tetrahedron packages.

It can readily be seen that the above described apparatus will automatically fill transport containers with individual packages without causing unnecessary rupture of the packages due to impact on the container from a long free fall drop into the container bottom.

Although I have described the specific method and apparatus of my invention, I contemplate that changes may be made without departing from the scope or spirit of the invention and desire to be limited only by the claims.

I claim:

1. Apparatus for tumble packing a plurality of articles into a transport container comprising: means supporting a transport container at a container filling station, conveying means operably associated with said means to support a transport container and mounted at a level higher than a transport container to be filled to drop a plurality of articles into the transport container, said conveying means including a slidably mounted chute mounted at a downward angle towards the transport container, means connected to said chute to slide said chute downwardly towards the transport container when it is desired to drop articles into the container and to retract said chute when a pre-determined number of articles have been dropped into the transport container, said means for supporting a transport container including a conveyor and a stop means operably associated with said conveyor to stop empty transport containers under said chute, means operably associated with said apparatus to open said stop means when a pre-determined number of articles have been deposited in the transport container to allow the container to move down said conveyor, said conveyor including a switch means downstream of said stop means in the path of travel of the transport container to close said stop means when contacted by the filled transport container to stop the next adjacent upstream transport container on the conveyor and said chute including a pivotally mounted gate member on the end thereof, said gate member being closed by said means to open said stop member when said stop means is opened.

2. Apparatus for tumbel packing a plurality of articles into a transport container comprising: means supporting a transport container at a container filling station, conveying means operably associated with said means to support a transport container and mounted at a level higher than a transport container to be filled to drop a plurality of articles into the transport container, said conveying means including a slidably mounted chute mounted at a downward angle towards the transport container, means connected to said chute to slide said chute downwardly towards the transport container when it is desired to drop articles into the container and to retract said chute when a pre-determined number of articles have been dropped into the transport container, said chute including a pivotally mounted gate member on the end thereof and means to automatically open said gate member when said chute substantially completes its downward movement.

3. The apparatus of claim 2 wherein said means for supporting a transport container including a conveyor and a stop means operably associated with said conveyor to stop empty transport containers under said chute, said apparatus including means to open said stop means when a pre-determined number of articles have been deposited in the transport container to allow the container to move down said conveyor, said conveyor including a switch means downstream of ssid stop means in the path of travel of the transport container to close said stop means when contacted by the filled transport container to stop the next adjacent upstream transport container on the conveyor, and said means to open stop member including a means to close said gate member when said stop member is opened.

* * * * *